US006508444B1

(12) United States Patent
Tseng

(10) Patent No.: US 6,508,444 B1
(45) Date of Patent: Jan. 21, 2003

(54) SWING SUPPORT ASSEMBLY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/947,693

(22) Filed: Sep. 6, 2001

(51) Int. Cl.[7] ..... A63G 9/00

(52) U.S. Cl. ..... 248/163.2; 472/118; 297/281; 135/124

(58) Field of Search ..... 472/118, 125; 248/163.2, 165, 317, 440.1, 127, 440; 297/273, 280, 281, 276, 277; 5/127, 130; 211/204, 206; 135/124, 128, 136, 114, 117, 144

(56) References Cited

U.S. PATENT DOCUMENTS 4,121,604 A * 10/1978 Rain ..... 135/118
5,241,717 A * 9/1993 Ward et al. ..... 248/165
6,036,605 A * 3/2000 Tseng ..... 297/281
D423,802 S * 5/2000 Tseng ..... D6/344

* cited by examiner

*Primary Examiner*—Ramon O. Ramirez
*Assistant Examiner*—Jon Szumny
(74) *Attorney, Agent, or Firm*—Ladas & Parry

(57) ABSTRACT

A swing support assembly includes a pair of upright side frames which are spaced apart from each other, and a horizontal hanger bar extending between the side frames. Each of the side frames includes a front leg unit and a rear leg unit. The front leg unit includes a pair of front leg members which are disposed side-by-side, and a front connecting member disposed between and secured to the front leg members. The rear leg unit includes a pair of rear leg members which are disposed side-by-side, and a rear connecting member disposed between and secured to the rear leg members. Each of the side frames further includes at least one intermediate connecting member disposed between the front and rear leg units and fastened to the front and rear connecting members.

6 Claims, 5 Drawing Sheets

SWING SUPPORT ASSEMBLY

BACKGROUND OF THE INVENTION

1. Field of the Invention

The present invention relates to a swing support assembly, more particularly to a swing support assembly having front and rear leg units, each including two upright leg members that are disposed side-by-side.

2. Description of the Related Art

FIG. 1 illustrates a conventional swing which includes a support assembly 1 with a pair of spaced-apart upright side frames 11, and a horizontal hanger bar 12 extending between upper ends of the side frames 11. A seat unit 2 is disposed among the side frames 11 and the horizontal bar 12, and is suspended on the horizontal bar 2. Each of the side frames 11 includes front and rear legs 111, 112 which have lower ends extending away from each other and upper ends extending close to each other, an upper connecting member 13 disposed between and secured to the upper ends of the front and rear legs 111, 112, and a lower connecting member 114 interconnecting intermediate sections of the front and rear legs 111, 112. The front and rear legs 111, 112 are typically formed as hollow tubes.

In practice, the side frames 11 must be designed to be sufficiently strong and stable so as to bear the weights of the horizontal bar 12, the seat unit 2 and the person(s) seated on the seat unit 2. Conventionally, when it is desired to increase the strength of the side frames 11, the radius of the front and rear legs 111 and the thickness of the tubular walls of the legs 111 are increased. However, the front and rear legs 111 are formed by drawing hollow metal tubes using a known drawing machine. It is noted that the cost of the drawing process is significantly increased when drawing metal tubes with increased radius and thickness.

SUMMARY OF THE INVENTION

Therefore, the main object of the present invention is to provide a swing support assembly which can be manufactured at a lower cost while having a relatively strong supporting strength.

Accordingly, the swing support assembly of the present invention includes a pair of upright side frames which are spaced apart from each other, and a horizontal hanger bar extending between the side frames. Each of the side frames includes a front leg unit and a rear leg unit. The front leg unit includes a pair of front leg members which are disposed side-by-side, and a front connecting member disposed between the front leg members and secured to the front leg members. The rear leg unit includes a pair of rear leg members which are disposed side-by-side, and a rear connecting member disposed between the rear leg members and secured to the rear leg members. Each of the side frames further includes at least one intermediate connecting member disposed between the front and rear leg units and fastened to the front and rear connecting members for fastening together the front and rear leg units of a respective one of the side frames.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
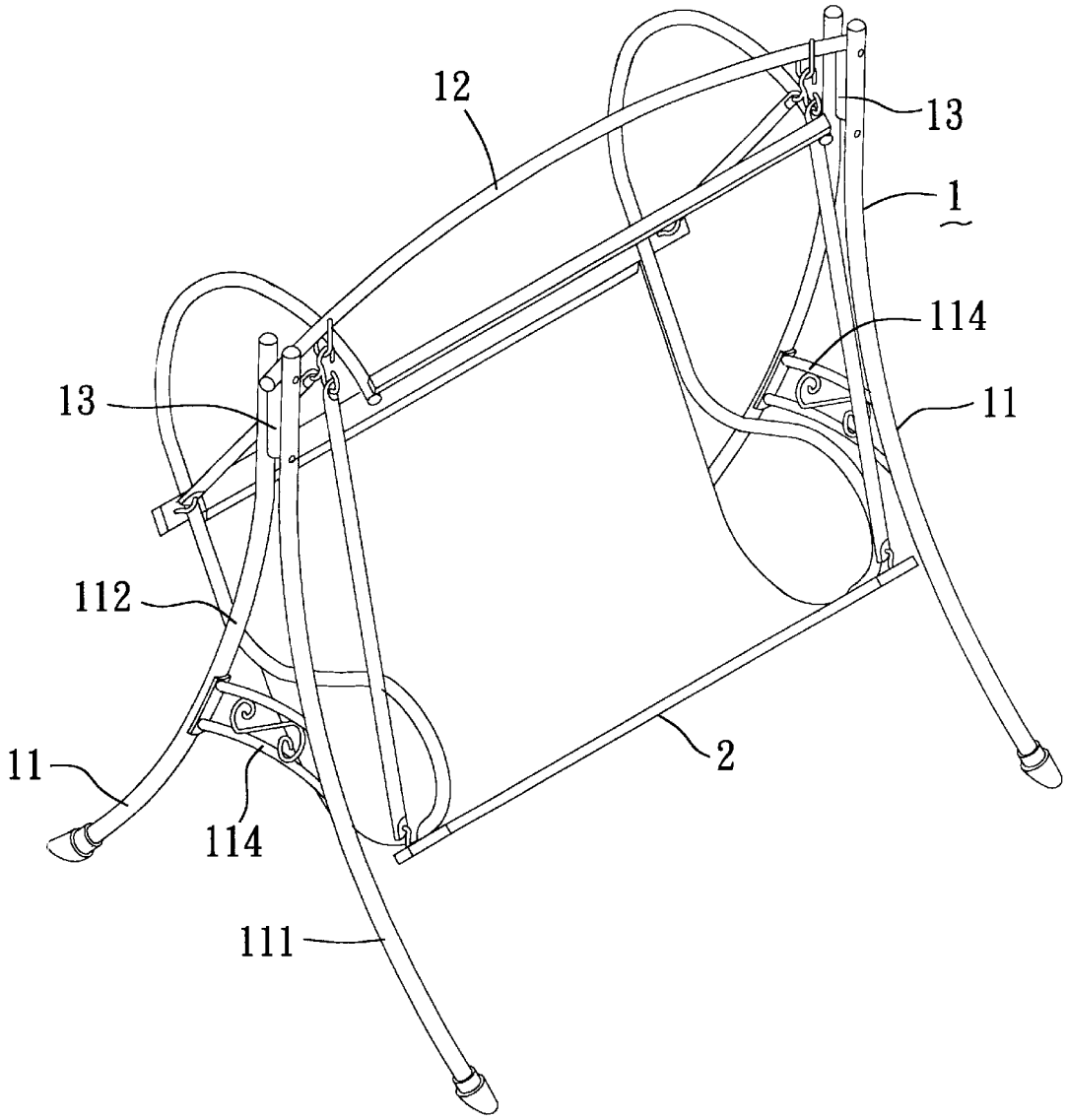
FIG. 1 PRIOR ART
FIG. 1 is a perspective view of a conventional swing assembly.
Figure 2:
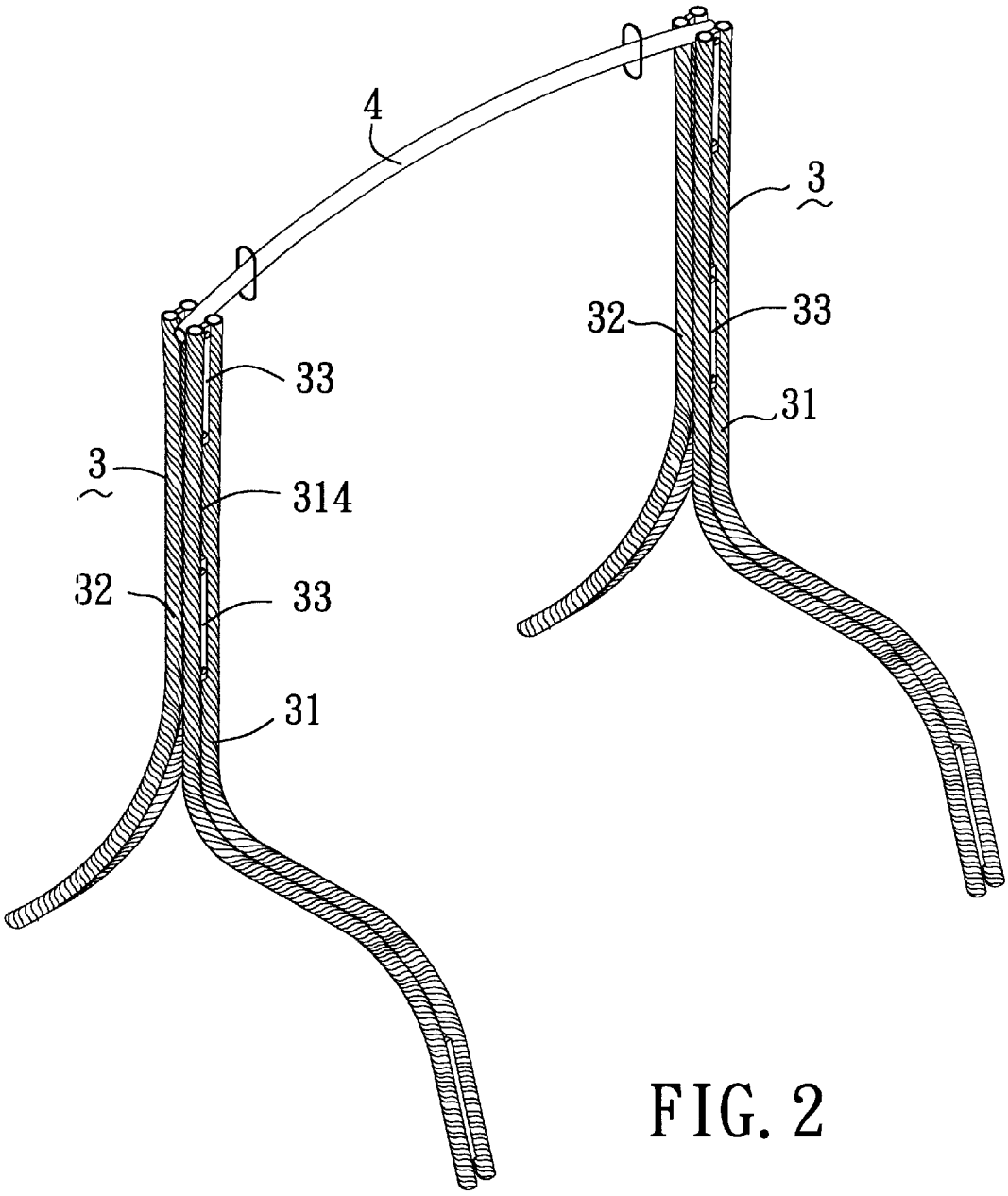
FIG. 2 is a perspective view of a preferred embodiment of a swing support assembly of the present invention.
Figure 3:
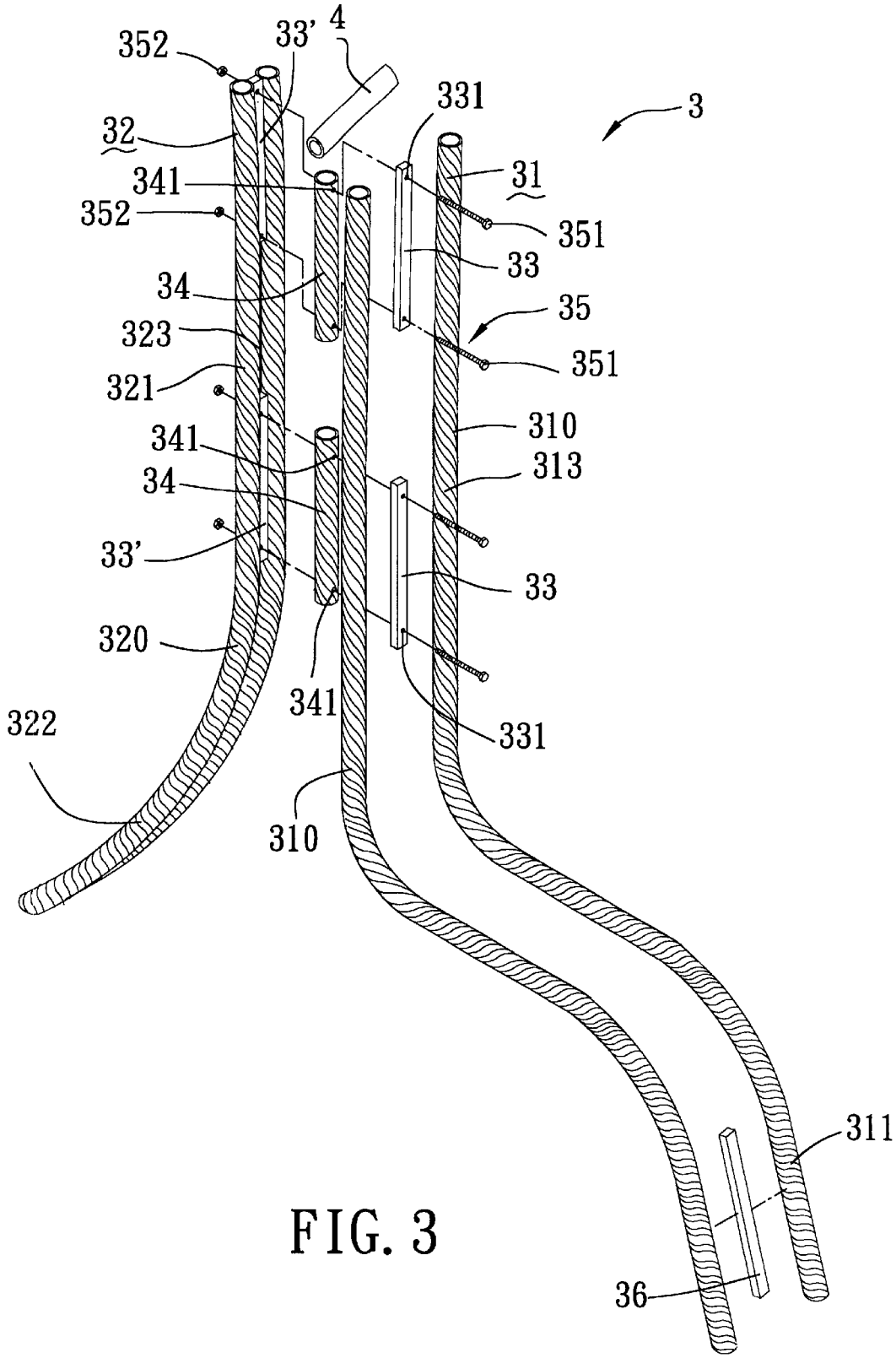
FIG. 3 is an exploded perspective view of a side frame of the swing support assembly of the preferred embodiment.
Figure 4:
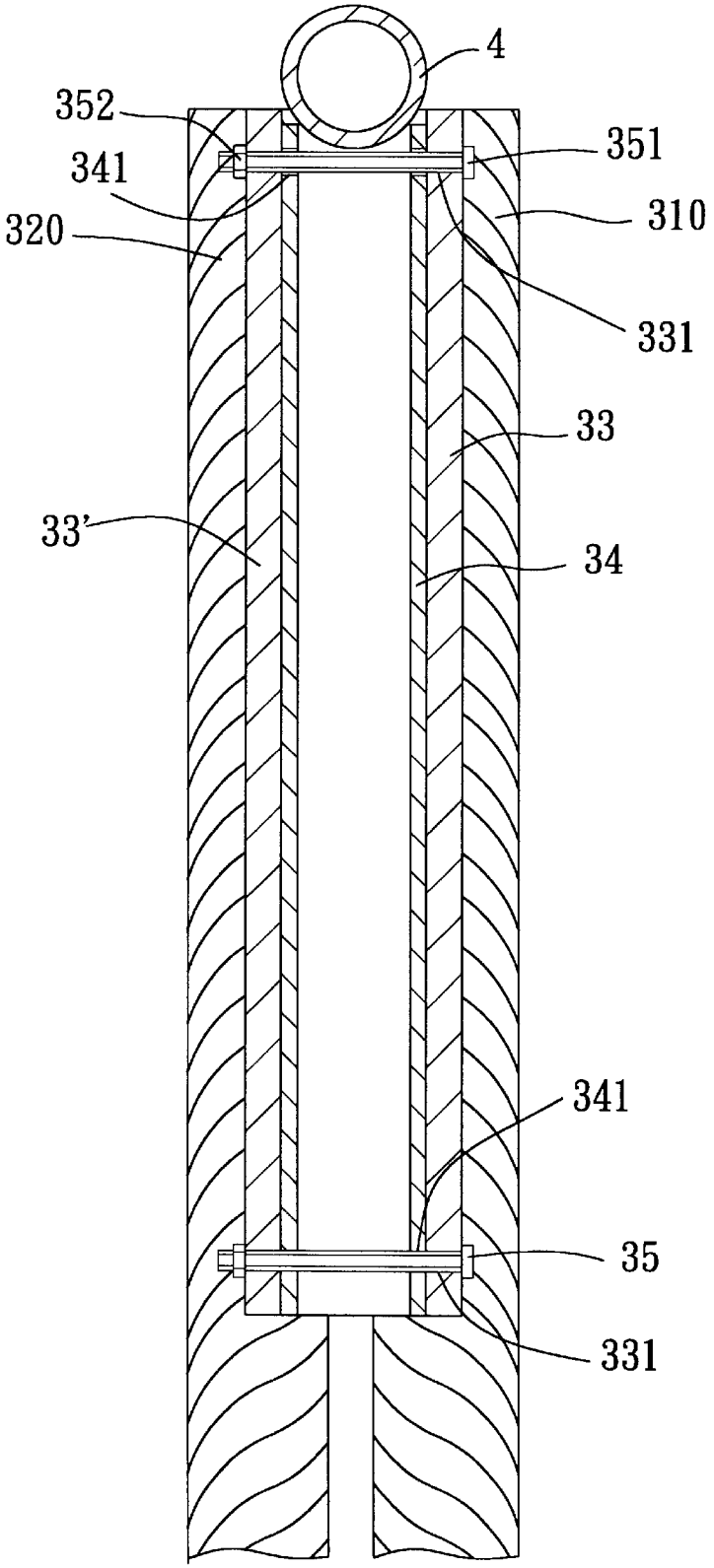
FIG. 4 is a fragmentary vertical sectional view of the side frame of FIG. 3.
Figure 5:
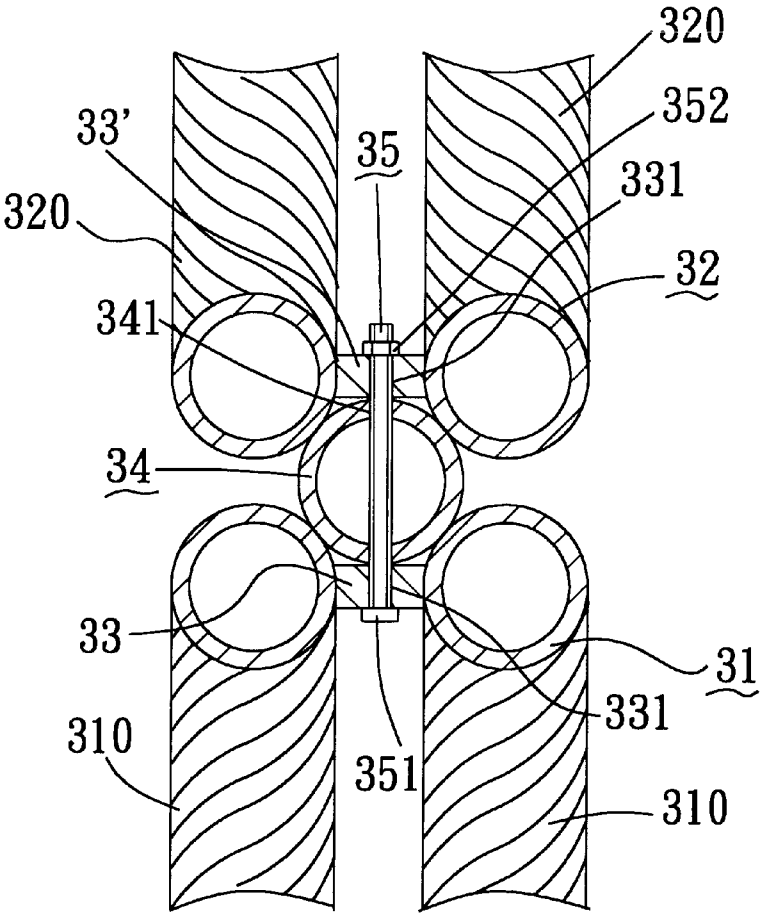
FIG. 5 is a fragmentary horizontal sectional view of the side frame of FIG. 3.

Referring to FIGS. 2 and 3, the preferred embodiment of the swing support assembly according to the present invention is shown to include a pair of spaced-apart upright side frames 3, and a horizontal hanger bar 4 extending between upper ends of the side frames 3.

Each of the side frames 3 includes a front leg unit 31 and a rear leg unit 32. The front leg unit 31 includes two front leg members 310 which are disposed side-by-side. Each of the front leg members 310 has an upwardly extending upper section 313, and a forwardly and downwardly extending lower section 311 that is adapted to be supported on a ground surface. The front leg unit 31 further includes two front connecting members 33 which are disposed between the upper sections 313 of the front leg members 310 and which are secured to the upper sections 313 of the front leg members 310 by welding. The front connecting members 33 are spaced-apart vertically such that a clearance 314 is formed among the front connecting members 33 and the upper sections 313 of the front leg members 310. Each of the front connecting members 33 is formed as an elongated metal strip with upper and lower end portions, and is disposed in an upright orientation parallel to the upper sections 313 of the front leg members 310. Each of the upper and lower end portions of the front connecting members 33 is formed with a fastener hole 331. The front leg unit 31 further includes a lower connecting member 36 disposed between and welded to the lower sections 311 of the front leg members 310. The lower connecting member 36 is similarly in the form of an elongated metal strip, and is disposed in an orientation generally parallel to the parts of the lower sections 311 to which the lower connecting member 36 is welded. In other embodiments, the metal strips, i.e., the front connecting members 33 and the lower connecting member 36, may be secured to the front leg members 310 by fasteners, such as screws or rivets.

The rear leg unit 32 includes two rear leg members 320 which are disposed side-by-side and which are disposed posteriorly of the front leg members 310, respectively. Each of the rear leg members 320 has an upwardly extending upper section 321, and a rearwardly and downwardly extending lower section 322 that is adapted to be supported on a ground surface. Two rear connecting members 33' are disposed between the upper sections 321 of the rear leg members 320 and are secured to the upper sections 321 of the rear leg members 320 by welding. The rear connecting members 33' are spaced-apart vertically such that a clearance 323 is formed among the rear connecting members 33' and the upper sections 321 of the rear leg members 320. The rear connecting members 33' are structurally identical to the front connecting members 33, and are disposed in an upright orientation parallel to the upper sections 321 of the rear leg members 320. The rear leg unit 32 further includes a lower connecting member (not visible) which is structurally identical to the lower connecting member 36 of the front leg unit 31 and which is disposed between and welded to the lower sections 322 of the rear leg members 320.

Each of the side frames 3 further includes two intermediate connecting members 34, each of which is configured as an integrally formed spiral tube with upper and lower end portions that are each formed with a fastener hole 341. The intermediate connecting members 34 are disposed uprightly between the front and rear leg units 31, 32, and are spaced-apart vertically. An upper one of the intermediate connecting members 34 is registered with an upper one of the front connecting members 33 and with an upper one of the rear connecting members 33'. A lower one of the intermediate connecting members 34 is registered with a lower one of the front connecting members 33 and with a lower one of the rear connecting members 33'. The intermediate connecting members 34 have upper and lower end portions formed respectively with fastener holes 341 which are aligned respectively with the fastener holes 331 in the front and rear connecting members 33, 33'. The intermediate connecting members 34 are fastened to the front and rear connecting members 33, 33' using a threaded fastener unit 35 which includes a plurality of threaded rods 351 and nuts 352. Each of the threaded rods 351 extends through a respective one of the fastener holes 331 in the front connecting members 33, an aligned one of the fastener holes 341 in the intermediate connecting members 34, and an aligned one of the fastener holes 331 in the rear connecting members 33', and engages a respective one of the nuts 352.

The horizontal hanger bar 4 has two opposite ends, each of which is disposed to rest on top of the upper one of the intermediate connecting members 34 of a respective one of the side frames 3, and is welded to the upper one of the intermediate connecting members 34.

Since each of the front and rear leg units 31, 32 of the side frames 3 of the swing support assembly of the present invention includes two leg members 310, 320 of a relatively small cross-section, the manufacturing cost can be significantly reduced due to the reduced cost in the drawing of metal tubes for forming the leg members 310, 320. Moreover, clearances 314, 323 are formed between the front connecting members 33, and between the rear connecting members 33' to absorb vibration generated during use of the swing.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing support assembly, comprising:

a pair of upright side frames which are spaced apart from each other, each of said side frames including a front leg unit and a rear leg unit, said front leg unit including a pair of front leg members which are disposed side-by-side, and a front connecting member disposed between said front leg members and secured to said front leg members, said rear leg unit including a pair of rear leg members which are disposed side-by-side, and a rear connecting member disposed between said rear leg members and secured to said rear leg members, each of said side frames further including at least one intermediate connecting member disposed between said front and rear leg units and fastened to said front and rear connecting members for fastening to said front and rear connecting members for fastening together said front and rear leg units of a respective one of said side frames; and a horizontal hanger bar extending between said side frame;

wherein each of said side frames further includes a threaded fastener unit extending through said front connecting member, said intermediate connecting member and rear connecting member for fastening together said front and rear leg units;

wherein each of said front and rear connecting members is formed as an elongated metal strip with upper and lower end portions, said intermediate connecting member being formed as an elongated tube with upper and lower end portions, said threaded fastener unit including threaded rods extending through said upper and lower end portions of said front, rear and intermediate connecting members.

2. The swing support assembly as claimed in claim 1, wherein said front connecting member is welded to said front leg members, said rear connecting member being welded to said rear leg members.

3. A swing support assembly, comprising:

a pair of upright side frames which are spaced apart from each other, each of said side frames including a front leg unit and a rear leg unit, said front leg unit including a pair of front leg members which are disposed side-by-side, and a front connecting member disposed between said front leg members and secured to said front leg members, said rear leg unit including a pair of rear leg members which are disposed side-by-side, and a rear connecting member disposed between said rear leg members and secured to said rear leg members, each of said side frames further including at least one intermediate connecting member disposed between said front and rear leg units and fastened to said front and rear connecting members for fastening to said front and rear connecting members for fastening together said front and rear leg units of a respective one of said side frames; and a horizontal hanger bar extending between said side frame;

wherein each of said front leg members includes a forwardly and downwardly extending lower section adapted to be supported on a ground surface, and an upwardly extending upper section connected to said lower section, each of said rear leg members including a rearwardly and downwardly extending lower section adapted to be supported on a ground surface, and an upwardly extending upper section connected to said lower section of a respective one of said rear leg members, said front leg unit including two of said front connecting members which are disposed between said upper sections of said front leg members and which are spaced apart vertically so as to define a clearance among said front connecting members and said upper sections of said front leg members, said rear leg unit including two of said rear connecting members which are disposed between said upper sections of said rear leg members and which are spaced apart vertically so as to define a clearance among said rear connecting members and said upper sections of said rear leg members, each of said side frames including two of said intermediate connecting members which are spaced apart vertically, an upper one of said intermediate connecting members being disposed between and being fastened to an upper one of said front connecting members and an upper one of said rear connecting members, a lower one of said intermediate connecting members being disposed between and being fastened to a lower one of said front connecting members and a lower one of said rear connecting member.

4. The swing support assembly as claimed in claim 3, wherein said front leg unit further includes a lower connecting member disposed between and secured to said lower sections of said front leg members, said rear leg unit further including a lower connecting member disposed between and secured to said lower sections of said rear leg members.

5. The swing support assembly as claimed in claim 3, wherein each of said front and rear leg members is an integrally formed elongated spiral tube.

6. The swing support assembly as claimed in claim 3, wherein said front connecting member is welded to said front leg members, said rear connecting member being welded to said rear leg members.

* * * * *